United States Patent [19]

Sutter

[11] Patent Number: 4,536,023

[45] Date of Patent: Aug. 20, 1985

[54] FIREPLACE SHOVEL ASSEMBLY FOR REMOVING AND TRANSPORTING ASHES

[76] Inventor: Robert E. Sutter, 1640 Edgewood Dr., Lodi, Calif. 95240

[21] Appl. No.: 519,126

[22] Filed: Aug. 1, 1983

[51] Int. Cl.[3] ..... A47F 13/08

[52] U.S. Cl. ..... 294/9; 294/55; 126/742

[58] Field of Search ..... 294/9, 49, 50.9, 55, 294/53.5, 50.8; 126/242; 110/165 R, 165 A; 220/2

[56] References Cited

U.S. PATENT DOCUMENTS 2,100,937 11/1937 Bowe ..... 126/242

4,299,419 11/1981 Kalan ..... 294/55

*Primary Examiner*—James B. Malbert

*Attorney, Agent, or Firm*—Flehr, Hohbach, Test, Albritton & Herbert

[57] ABSTRACT

A manually handled shovel assembly having a scoop at one end of an auger and an enclosed container at the other end. Operating the auger conveys scooped material into the container to be safely transported to a point of discharge. The bottom of the container quickly opens to dump out the contents.

5 Claims, 5 Drawing Figures

FIREPLACE SHOVEL ASSEMBLY FOR REMOVING AND TRANSPORTING ASHES

This invention pertains to a fireplace cleanout apparatus, characterized by a readily dischargeable container into which ashes, and the like, can be stored in a sealed manner while being transported from the fireplace to a point of discharge.

The cleaning of a fireplace, and the like, is typically a messy job whereby much attention becomes focused upon preventing the ashes from drifting into the air in a person's living space or elsewhere while transporting the ashes for disposal.

Accordingly, there has been a need for an improved means for removing and transporting ashes from a fireplace free of the possibility of ashes blowing into a person's living space or elsewhere.

In general, a fireplace shovel assembly has been provided having an elongate auger assembly carrying a scoop from one end to supply ashes or other scooped material into that end of the auger. A sealed container mounted from the other end of the auger assembly serves to receive scooped material. Means for rotating the auger to convey material from the scoop end into the container have been provided, as well as means for quickly opening the container, while carried by the auger assembly, in order to quickly discharge the contents thereof.

In general, it is an object of the present invention to provide an improved fireplace shovel assembly and, more particularly, to provide an improved fireplace shovel assembly having a sealed container carried by the shovel for receiving the ashes for transport.

It is yet another object of the invention to provide a fireplace shovel assembly of the kind described having means for quickly discharging the contents of the container carried by the shovel assembly.

Other objects of the invention will become more readily evident from the following detailed description of preferred embodiments when considered in conjunction with the drawings.

Figure 1:
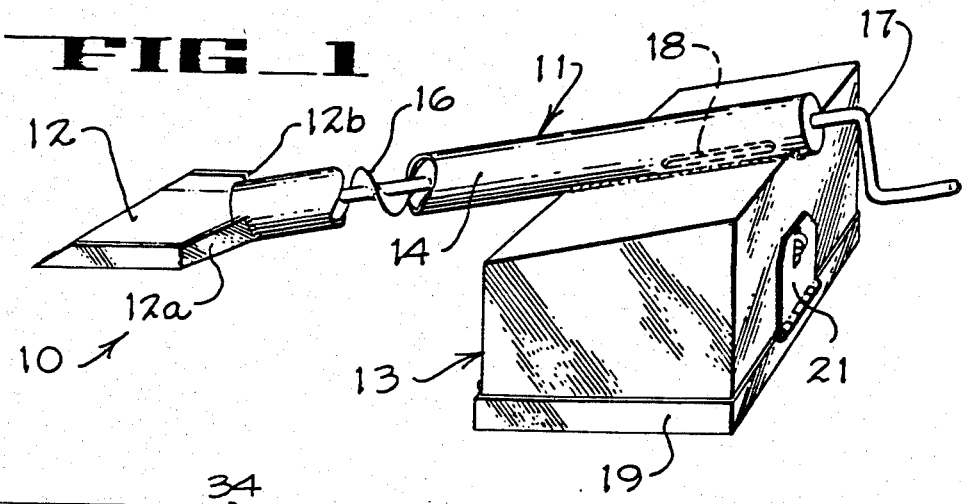
FIG. 1 shows a diagrammatic perspective view of a shovel assembly according to the invention as viewed from the rear.

A portable fireplace shovel assembly for removing and manually transporting ashes from a fireplace includes an elongate auger assembly 11 supporting a scoop 12 at one end and a closed or sealed container 13 at the other end. The overall apparatus is arranged to be sufficiently light and sufficiently small to be manually manipulated by a person cleaning out a fireplace, small furnace, etc.

Auger assembly 11 includes an elongate, hollow, cylindrical body 14 open at the end adjacent scoop 12 and closed at the other end. Assembly 11 further includes a screw auger element 16 mounted for rotation within body 14 to serve as a conveyor to carry scooped material, such as ashes, therealong from one end. Auger assembly 11 further includes means such as a crank 17 carried at its upper end for rotating the auger.

Container 13, welded to the upper end of body 14, includes an opening 18 formed through both container 13 and body 14 to provide a passageway for discharging material conveyed, upwardly through body 14 by auger element 16.

Scoop 12 includes rearwardly converging and upwardly extending side walls 12*a*, 12*b* merging with body 14 at the lower end for directing scooped material into the lower open end. Container 13 includes a readily releasable bottom door 19 held in its closed position by means of a hasp 21 or other suitable means. Door 19, accordingly, provides a bottom panel for supporting the ashes thereon. Door 19 further includes an upwardly directed flange 22 formed by folding the four edge margins of a rectangular panel or sheet of material upwardly. Flanges 22 may be secured at their corners, as by welding. Accordingly, flanges 22 define the boundary of a bottom panel extending across and beneath container 13.

Hinges 23 support door 19 to readily open from beneath scooped material within container 13. The upper leaf of each of the hinges 23 has been welded or otherwise secured to the back wall 13*a* of container 13, while the other leaf of each hinge is secured to the adjacent flange 22 of bottom door 19.

Accordingly, in operation the portable fireplace shovel is manipulated by forcing scoop 12 into a mound of ashes and, thereafter, rotating crank 12 to convey the ashes upwardly to be discharged into container 13. When container 13 has been filled appropriately, the entire apparatus can be carried to an appropriate point of discharge whereby upon releasing hasp 21 bottom 19 drops downwardly and rearwardly from beneath the contents of container 13.

Figure 3:
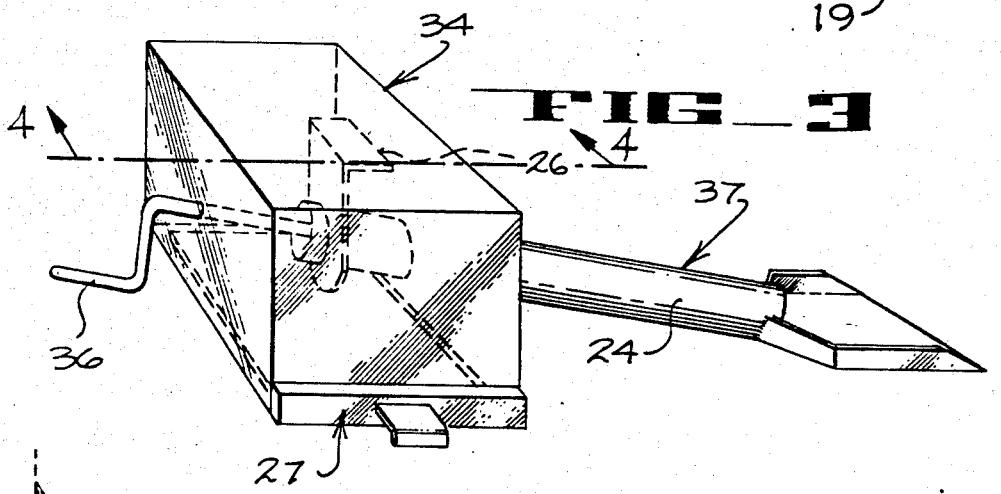
FIG. 3 shows a perspective view according to another embodiment of the invention.
Figure 2:
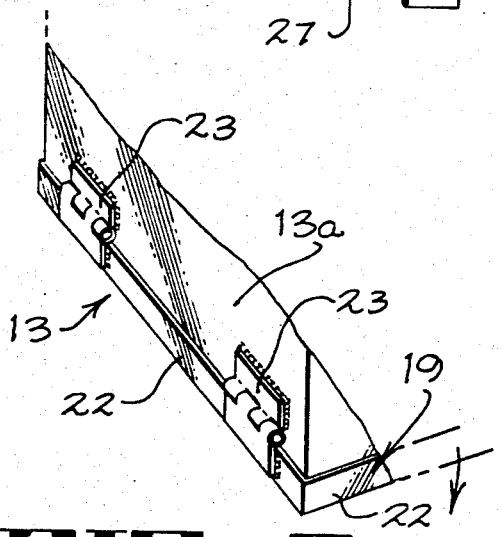
FIG. 2 shows an enlarged detail view in perspective showing the front of a container portion of the invention shown in FIG. 1.
Figure 4:
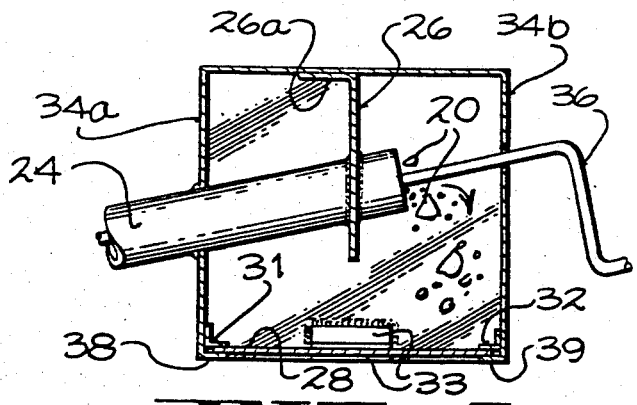
FIG. 4 shows a section view, taken along the line 4—4 of FIG. 3, showing additional detail of the embodiment of FIG. 3.
Figure 5:
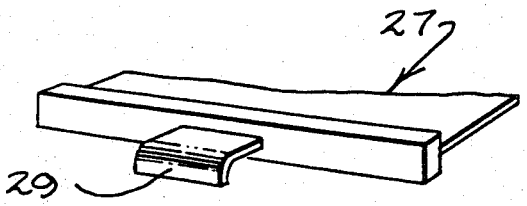
FIG. 5 shows an enlarged, perspective view of a detail of the bottom of FIG. 4.

According to another embodiment, as shown in FIGS. 3, 4 and 5, body 24 is open at its upper end and passes directly through the back wall 34*a* of container 34. In this way, ashes and other "scooped materials" 20 can be discharged directly from the upper end of body 24 into container 34.

Crank 36 extends outwardly through the opposite side wall 34*b* of container 34 to support auger assembly 37. Additional support is provided to the upper end of auger assembly 37 by means of a downwardly depending hanger or strap 26 having an opening therethrough sufficient to receive the upper end of body 24. Strap 26 includes a short flange 26*a* welded to the top of container 34.

Means forming a bottom closure panel includes the readily removable panel element 27 forming the floor 28 of container 34. Panel element 27 includes a grip 29 whereby floor 28 can be readily removed. Panel element 27 rides in a pair of confronting guide ways formed by spaced parallel flanges 31, 32, welded along an associated side wall of container 34 and above a bottom flange 38, 39 respectively.

In addition, in order to provide limited support to the inserted end, a pair of spaced apart flanges 33 serve to receive the inserted end edge of element 27.

From the foregoing, it will be readily evident that there has been provided an improved, portable fireplace shovel assembly for removing and transporting ashes from a fireplace or other region where it is employed. It will be further evident that the ashes that are being transported will be safely captured within a substantially sealed container or enclosure whereby the ashes will not drift elsewhere, as through a person's living space, or otherwise until the container is dumped.

What is claimed:

1. A portable fireplace shovel assembly to be manipulated by hand as a unit for manually scooping and transporting ashes from a residential fireplace comprising an elongate, hollow, cylindrical body open at both ends thereof, a scoop carried by one end of said body, said scoop having rearwardly converging side walls merging with said body at said one end for directing scooped material into said one end, a readily dischargeable container carried by the other end of said body to be manually transported with said body and scoop, means forming a passageway leading from said body into said container, and a screw auger conveyor disposed to rotate within said body to carry scooped material therealong from said one end to said passageway to pass into said container, and means carried at said other end of said body for rotating said auger to transport said scooped material from said one end to said container.

2. A fireplace shovel assembly according to claim 1 in which said container includes a bottom panel and means for readily removing said bottom panel from beneath scooped material within said container to readily discharge the contents of said container.

3. A fireplace shovel assembly according to claim 1 wherein said container includes a body portion and a closure panel serving to seal the bottom of said container, hinge means connecting an edge of said closure panel to said body portion, and means for retaining said closure panel to seal said container, the last named means being readily releasable to permit said panel to pivot downwardly and away from said body portion for quickly discharging the contents of said container.

4. A portable fireplace shovel assembly to be manipulated by hand as a unit for manually scooping ashes from a residential fireplace into a container carried with the assembly, said assembly comprising an elongate, portable auger assembly including an elongate housing open at each end and a screw auger element therein, a scoop carried from one end of said auger assembly to supply scooped material into said one end thereof, a sealed container fixed to and carried from the other end of said auger assembly for receiving said material therefrom and to be manually transported with said shovel assembly, means for rotating said auger to convey scooped material from said scoop into said container to permit the scooped material to be manually transported to a point of discharge free of the possibility of spreading the contents of said container into a person's living space, and means for quickly opening the bottom of said container while carried by said auger assembly to discharge the contents thereof.

5. A fireplace shovel assembly according to claim 4 wherein the last named means includes a hinged bottom panel readily releasable to drop from beneath the contents of said container.

* * * * *